US011260656B2

(12) United States Patent
Gardner et al.

(10) Patent No.: US 11,260,656 B2
(45) Date of Patent: Mar. 1, 2022

(54) SETPOINT REGISTERS TO ADJUST FIRING PULSES

(71) Applicant: Hewlett-Packard Development Company, L.P., Spring, TX (US)

(72) Inventors: James Michael Gardner, Corvallis, OR (US); Daryl E. Anderson, Corvallis, OR (US); Eric Martin, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/763,246

(22) PCT Filed: Dec. 15, 2017

(86) PCT No.: PCT/US2017/066835
§ 371 (c)(1),
(2) Date: May 12, 2020

(87) PCT Pub. No.: WO2019/117964
PCT Pub. Date: Jun. 20, 2019

(65) Prior Publication Data
US 2020/0316937 A1 Oct. 8, 2020

(51) Int. Cl.
*B41J 2/045* (2006.01)

(52) U.S. Cl.
CPC ..... *B41J 2/04591* (2013.01); *B41J 2/0458* (2013.01); *B41J 2/04563* (2013.01)

(58) Field of Classification Search
CPC ... B41J 2/04563; B41J 2/0459; B41J 2/04591
See application file for complete search history.

(56) References Cited

U.S. PATENT DOCUMENTS

| | | | | |
|---|---|---|---|---|
| 5,107,276 | A | 4/1992 | Kneezel et al. | |
| 5,422,664 | A | 6/1995 | Stephany | |
| 6,302,507 | B1 | 10/2001 | Prakash et al. | |
| 6,322,189 | B1 * | 11/2001 | Anderson | B41J 2/04528 347/17 |
| 7,125,090 | B1 | 10/2006 | Silverbrook et al. | |
| 7,611,220 | B2 | 11/2009 | Silverbrook | |
| 7,938,500 | B2 | 5/2011 | Sheahan et al. | |
| 2007/0222807 | A1 * | 9/2007 | Silverbrook | B41J 2/1646 347/17 |
| 2008/0084441 | A1 * | 4/2008 | Sheahan | B41J 2/1404 347/13 |

FOREIGN PATENT DOCUMENTS

WO WO-2013006152 A1 1/2013

OTHER PUBLICATIONS

Alaman, J. et al., Inkjet Printing of Functional Materials for Optical and Photonic Applications, Nov. 2016, https://www.ncbi.nlm.nih.gov/pmc/articles/PMC5457235/.

* cited by examiner

*Primary Examiner* — Scott A Richmond
(74) *Attorney, Agent, or Firm* — Fabian VanCott

(57) ABSTRACT

A fluidic die that includes at least one temperature sensor coupled to at least one zone of the fluidic die, a setpoint register to receive a target temperature setpoint for the fluidic die wherein a detected temperature presented by the at least one temperature sensor is compared to the target temperature setpoint using a comparator module to get a firing pulse adjustment value, and a firing pulse used to convey an amount of fluid within the die is adjusted using the firing pulse adjustment value.

20 Claims, 7 Drawing Sheets

SETPOINT REGISTERS TO ADJUST FIRING PULSES

BACKGROUND

Printing devices include a pen used to eject printing fluid onto the surface of print media. The pen may be a page-wide array of silicon dies, a printing fluid cartridge including at least one silicon die, or any number of devices. Some of the silicon dies include a number of fluid chambers fluidically coupled to an orifice in which a resistive heater is placed. The resistive heater may cause a drive bubble to form within the fluid chambers causing a metered amount of printing fluid to be ejected out of the orifice.

BRIEF DESCRIPTION OF THE DRAWINGS

The accompanying drawings illustrate various examples of the principles described herein and are part of the specification. The illustrated examples are given merely for illustration, and do not limit the scope of the claims.

Figure 1:
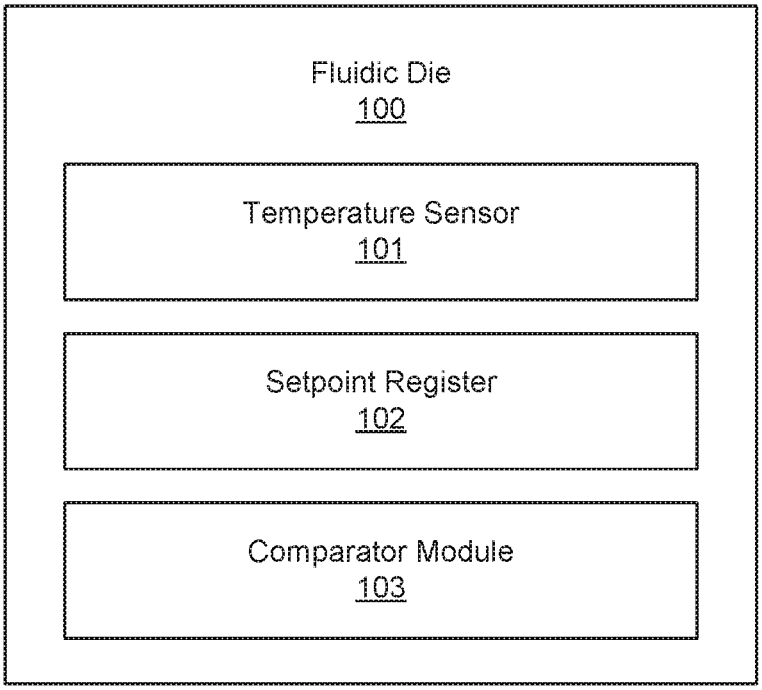
FIG. 1 is a block diagram of a fluidic die according to an example of the principles described herein.

Throughout the drawings, identical reference numbers designate similar, but not necessarily identical, elements. The figures are not necessarily to scale, and the size of some parts may be exaggerated to more clearly illustrate the example shown. Moreover, the drawings provide examples and/or implementations consistent with the description; however, the description is not limited to the examples and/or implementations provided in the drawings.

DETAILED DESCRIPTION

Silicon dies include a number of fluid chambers fluidically coupled to an orifice in which a resistive heater is placed. The resistive heater may cause a drive bubble to form within the fluid chambers causing a metered amount of printing fluid to be ejected out of the orifice. During firing, the temperature of the silicon die may increase. One of the contributing factors to the increased temperature of the silicon die may be the firing of the resistive heaters therein. The increased temperatures may change the fluidic characteristics of the printing fluid and/or printing architecture.

The present specification describes a fluidic die that includes at least one temperature sensor coupled to at least one zone of the fluidic die, a setpoint register to receive a target temperature setpoint for the fluidic die wherein a detected temperature presented by the at least one temperature sensor is compared to the target temperature setpoint using a comparator module to get a firing pulse adjustment value, and a firing pulse used to convey an amount of fluid within the die is adjusted using the firing pulse adjustment value.

The present specification also describes a method for ejecting fluid that includes loading a temperature setpoint value into a setpoint register, with a temperature sensor, detecting a temperature value from at least one zone on a fluid ejection device, comparing the temperature setpoint value with the temperature value to obtain a temperature difference value, and adjusting a firing pulse sent to the fluid ejection device based on the difference value.

The present specification further describes a computer program product for ejecting fluid, the computer program product that includes a computer readable storage medium comprising computer usable program code embodied therewith, the computer usable program code to, when executed by a processor, load a temperature setpoint value into a setpoint register, with a temperature sensor, detect a temperature value from at least one zone on a fluid ejection device, compare the temperature setpoint value with the temperature value to obtain a temperature difference value, and adjust a firing pulse sent to the fluid ejection device based on the difference value.

As the temperature changes and, more specifically, as the heat increases, the fluid ejection characteristics of the die may also change as well as the viscosity of the fluid being ejected. As a result, the quality of print rendered by the fluid ejection device may change based on the temperature experienced by the die. Temperature sensors may be provided to monitor the changes in temperature. However, this monitoring may not prevent the die from heating up or maintaining a consistent operating temperature.

Turning now to the figures, FIG. 1 is a block diagram of a fluidic die (100) according to an example of the principles described herein. The fluidic die (100) may include at least one temperature sensor (101), at least one setpoint register (102) and a comparator module (103).

In an example, the fluidic die (100) may be partitioned into a number of zones as described herein. These zones may each include at least one temperature sensor (101), at least one comparator module (103), and at least one setpoint register (102). In an example, the temperature sensor (101), setpoint register (102), and/or comparator module (103) may be used across a plurality of the zones.

As described herein, the setpoint register (102) may be any digital storage element that maintains any digital count value equivalent to a target temperature setpoint. The setpoint register (102) may be used to hold a target temperature setpoint describing a temperature at which the fluidic die (100) is to be held at. The comparator module (103) may then, during operation, compare the target temperature setpoint to a measured temperature by a temperature sensor (101) on at least one zone.

Figure 2:
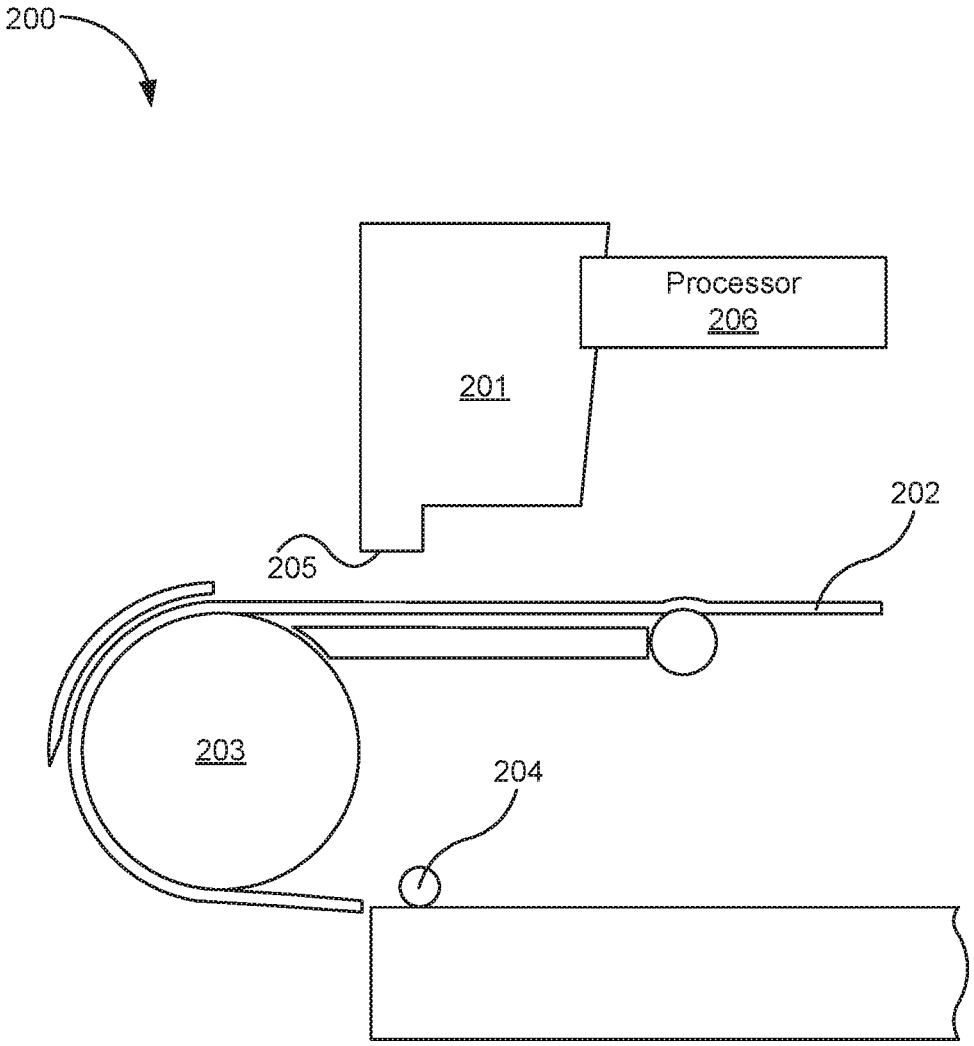
FIG. 2 is a diagram of a printing device according to an example of the principles described herein.

FIG. 2 is a diagram of a printing device (200) according to an example of the principles described herein. In this example, the printing device (200) includes the fluidic die (FIG. 1, 100) of FIG. 1. The printing device (200) of FIG. 2 may include a fluidic die (201) positioned over a printing medium (202) traveling through the printing device (200). The printing device (200) may further include a processor (206) that is in communication with the fluidic die (201) and is programmed to use sensors within the fluidic die (201) to detect the temperature of the fluidic die (201) and/or zones of the fluidic die (201).

The printing medium (202) is pulled from a stack of media individually through the use of rollers (203, 204). In other examples, the printing medium is a continuous sheet or web. The printing medium may be, but is not limited to, paper, cardstock, poster board, vinyl, translucent graphics medium, other printing media, or combinations thereof. The printing medium may also include three-dimensional materials used to manufacture three-dimensional objects and the presently described systems and method may apply to a three-dimensional printing system as well. The present specification, therefore, contemplates for the use of the circuits, systems and methods described herein with three-dimensional printing devices.

The fluidic die (201) may have a number of orifices formed in its underside (205). Each orifice may include a fluid ejection device that is in electrical communication with a processor (206) that instructs the fluid ejection devices to fire at specific times by receiving a firing signal. The fluid ejection device, in some examples, may be a heating element, resistive heater, a thin-film resistor, other mechanism that may create a bubble within a fluid chamber housing the fluid ejection device. In other examples, a piezo-electric element may create pressure in the fluid chamber to file a desired amount of printing fluid out of a matching orifice.

Figure 3:
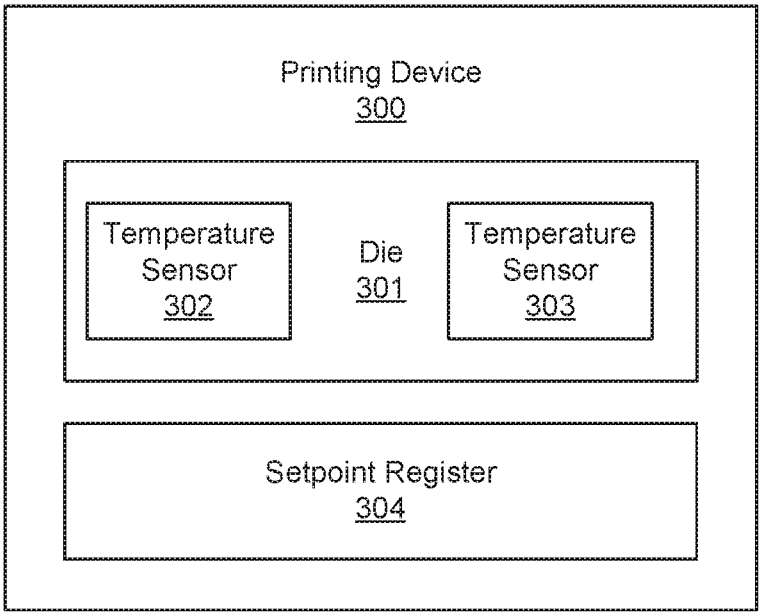
FIG. 3 is a block diagram of a printing device according to an example of the principles described herein.

FIG. 3 is a block diagram of a printing device (300) according to an example of the principles described herein. The printing device (300) may include at least one die (301). The die (301) may be separated, at least logically or spatially, into a plurality of zones. The zones may include at least one fluid ejection device housed within a fluid chamber and used to eject a fluid out of an orifice. Each of the zones may include a temperature sensor (302, 303). Each of the temperature sensors (302, 303) may detect a real-time temperature of each zone and relay that data to, for example, a setpoint register (304). The setpoint register (304) may be any digital storage element the maintains any digital count value equivalent to a target temperature setpoint. The setpoint register (304) may be used to hold a target temperature setpoint the fluidic die is supposed to achieve provided by, for example, a printing device. Each zone's temperature measurement may be provided to an analog-to-digital convertor. The output digital value may then be sent to a comparator module to compare a target temperature setpoint to the digital signal. The comparator module may be any type of logic, executable computer readable program code, and/or device that compares, at least, a detected temperature presented by at least one temperature sensor to the target temperature setpoint. The comparison result (i.e., difference) received from the comparator module is then used to "look up" an adjustment value on a look-up table to provide back to the zone for adjusting a firing pulse within that zone.

In an example, the output of the temperature sensors (302, 303) may be an analog signal. This analog signal may be converted to a digital signal prior to being received by the setpoint register (304). In this example, an analog-to-digital convertor may convert the analog signal from the temperature sensors (302, 303) to digital signals.

In an example, a memory device may maintain a look-up table (LUT) on or associated with the die (301) and/or a pen associated with the die (301). The LUT may be loaded with a number of adjustment values that are used to adjust an incoming firing signal based on a difference between a measured temperature value by each of the temperature sensors (302, 303) and a target temperature setpoint.

During operation, the printing device (300) and/or a processor may send, to the setpoint register (304), a target temperature setpoint. The target temperature setpoint may be a digital signal that indicates a target temperature each of the zones of the die (301) should be set at in order to maintain optimal temperatures at the die (301) during operation. While, before, or after the setpoint register (304) has received the target temperature setpoint, the LUT may be loaded with a number of adjustment values used to compensate for temperature variations across the zones of the die (301) and, on a zone level, compensate for temperature variations across the die (301) based on thermal deltas with the target temperature by adjusting a firing pulse. As described above, each of the temperature sensors (302, 303) may send detected temperature values with regard to each of their respective temperature values to an analog-to-digital convertor to have each of the outputs of the temperature sensors (302, 303) be converted from an analog signal to a digital signal. The converted digital signals may then be sent to the setpoint register (304).

During operation, the process may continue with comparing the target temperature setpoint received by the setpoint register (304) with the digital signals received from the analog-to-digital convertor. A temperature different value may be used in connection with the LUT to determine a firing pulse adjustment value. The firing pulse adjustment value may then be used to either extend or shorten the length of the firing pulse sent to each of the fluid ejection devices within the zones.

This process may continue with each zone individually or simultaneously based on the circuitry coupled to the die (301). This process may continue for a duration of time or may continue until a print job has been completed. In the examples presented above, the temperature of the die (301) may be increased through use of the fluid ejection devices or other circuitry formed within or on the die (301). When this occurs, the setpoint register (304) may provide a target temperature setpoint that is to be used to shorten any firing pulse sent to each of the fluid ejection devices using the firing pulse adjustment value derived by the setpoint register (304) and LUT as described herein. Additionally, in the examples presented above, the temperature of the die (301) may be relatively cooler than the target temperature setpoint. In this example, the setpoint register (304) may provide a target temperature setpoint that is to be used to increase the amount of energy used to actuate fluidic actuators within the die (301) by extending any firing pulse sent to each of the fluid ejection devices using the firing pulse adjustment value derived by the setpoint register (304) and LUT as described herein. Thus, at any point during operation of the printing device (300) and its die (301), the actuation energy used to actuate the fluid ejection devices may be adjusted to compensate for temperature variations across the die (301) and temperature deviance from target temperature setpoint.

In an example, the adjustment of the firing pulse based on the firing pulse adjustment value may be done by adding a number of clock counts to the firing pulse when the temperature of the zone is cooler than the target temperature setpoint or substracting a number of clock counts to the firing pulse when the temperature of the zone is warmer than the target temperature setpoint.

Figure 4:
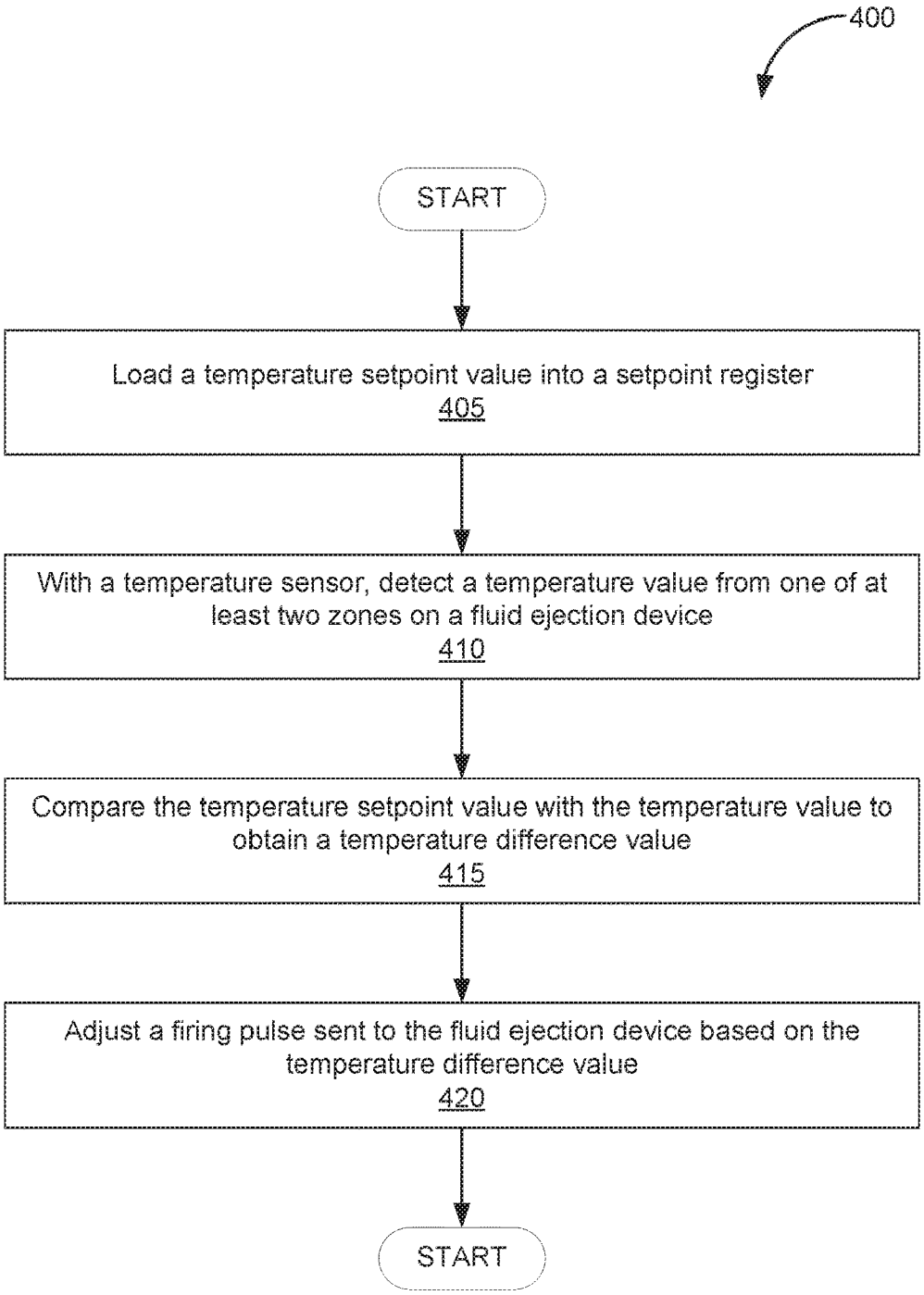
FIG. 4 is a flowchart showing a method of ejecting fluid according to an example of the principles described herein.

FIG. 4 is a flowchart showing a method (400) of ejecting fluid according to an example of the principles described herein. The method (400) may begin with loading (405) a temperature setpoint value into a setpoint register (304). The temperature setpoint value may be dependent on the type of fluid passing through the die (301), the type of materials the die (301) is made of, the architecture of the die (301), among other considerations that would affect an operating temperature of the die (301).

The method (400) may continue with detecting (410) a temperature value from at least one zone on a fluid ejection device with a temperature sensor (302, 303). The temperature setpoint value may then be compared (315) with the temperature value to obtain a temperature difference value. The method (400) may then continue by adjusting (420) a firing pulse sent to the fluid ejection device based on the temperature difference value. The method (400) may be executed any number of iterations until, for example, a print job is completed, a threshold number of iterations have occurred, or any other standard based on instructions received from a processor of the printing device (200).

Figure 5:
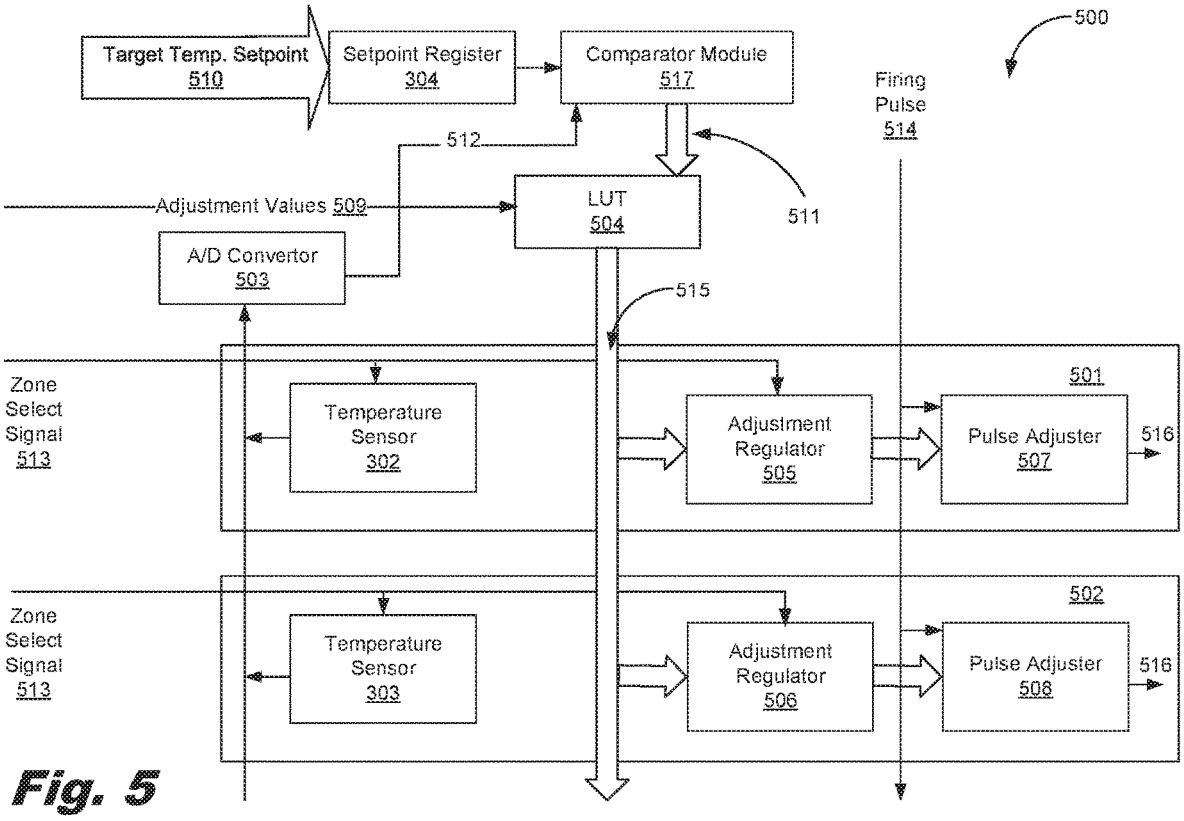
FIG. 5 is a circuit diagram of an example circuit used to perform the method of FIG. 3 according to an example of the principles described herein.

FIG. 5 is a circuit diagram of an example circuit (500) used to perform the method (400) of FIG. 4 according to an example of the principles described herein. The circuit (500) shown in FIG. 5 is merely an example and the present specification contemplates any form of circuit that can accomplish the method (400) described herein.

The circuit (500) may include at least one temperature sensor (202, 203) placed to detect the temperature of an individual zone (501, 502). The circuit (500) also includes a setpoint register (304), an analog-to-digital convertor (503), and a look-up table (LUT) (504) as described herein. Each zone (501, 502) may further include its own adjustment regulator (505, 506) and pulse adjuster (507, 508).

During the operation of the circuit (500), a number of adjustment values (509) is loaded to the LUT (504). These adjustment values are used to determine to what degree the temperature of the zone (501, 502) of the die (301) is to be adjusted and accordingly how and if the firing pulse is to be adjusted.

During operation, a target temperature setpoint (510) is loaded to the setpoint register (304). Again, this target temperature setpoint (510) is determined based on a number of factors based on a temperature of the die (301) that causes the die (301) to operate at its highest efficiency and productivity.

In an example, a single zone (501, 502) may receive a zone select signal (513) from a computing device, a processor, and/or a printing device (200) to select a zone to be analyzed. The zone select signal (513) may cause the temperature sensor (302, 303) in that zone (501, 502) to provide an analog signal representative of the temperature of the zone (501, 502) to the analog-to-digital convertor (503) as described herein. Additionally, the zone select signal (513) may indicate to an adjustment regulator (505, 506) of a zone (501, 502) that, based on a received adjustment value (515) that an incoming firing pulse (514) is to be adjusted.

The analog-to-digital convertor (503), upon receiving the detected temperature value from the temperature sensor (302, 303) converts the analog output of the temperature sensor (302, 303) to a digital signal. The analog-to-digital convertor (503) then sends the digital temperature value (512) to a comparator module (517). It is here that a comparison of the digital temperature value (512) to the target temperature setpoint (510) from the setpoint register (510) is made and a difference value (511) is determined. The difference value (511) is then sent to the LUT (504) in order to determine an adjustment value (515) that compensates for the difference value (511) as described herein.

The LUT (504) passes the adjustment value (515) onto the adjustment regulator (505, 506) which sends the value onto a pulse adjuster (507,508). The pulse adjuster (507,508) may adjust an incoming firing pulse (514) so as to either extend or shorten the length of the firing pulse (514). The adjusted firing pulse (516) is then sent onto a fluid ejection device to activate the fluid ejection device accordingly. In this manner, the printing device (300) may compensate for thermal variations in the zones (501, 502) and thereby increase the quality of any printed product.

Although the above description is directed to a printing device and/or any device that ejects an amount of fluid, the present specification contemplates the use of the circuit (500) and methods (400) in connection with other types of microfluidic devices that may implemented heating devices such as the fluid ejection device. In an example, the circuit (500) and method (400) may be used in a diagnostic microfluidic chip that receives an analyte and performs certain diagnosis and/or reactions with on the analyte.

Figure 6:
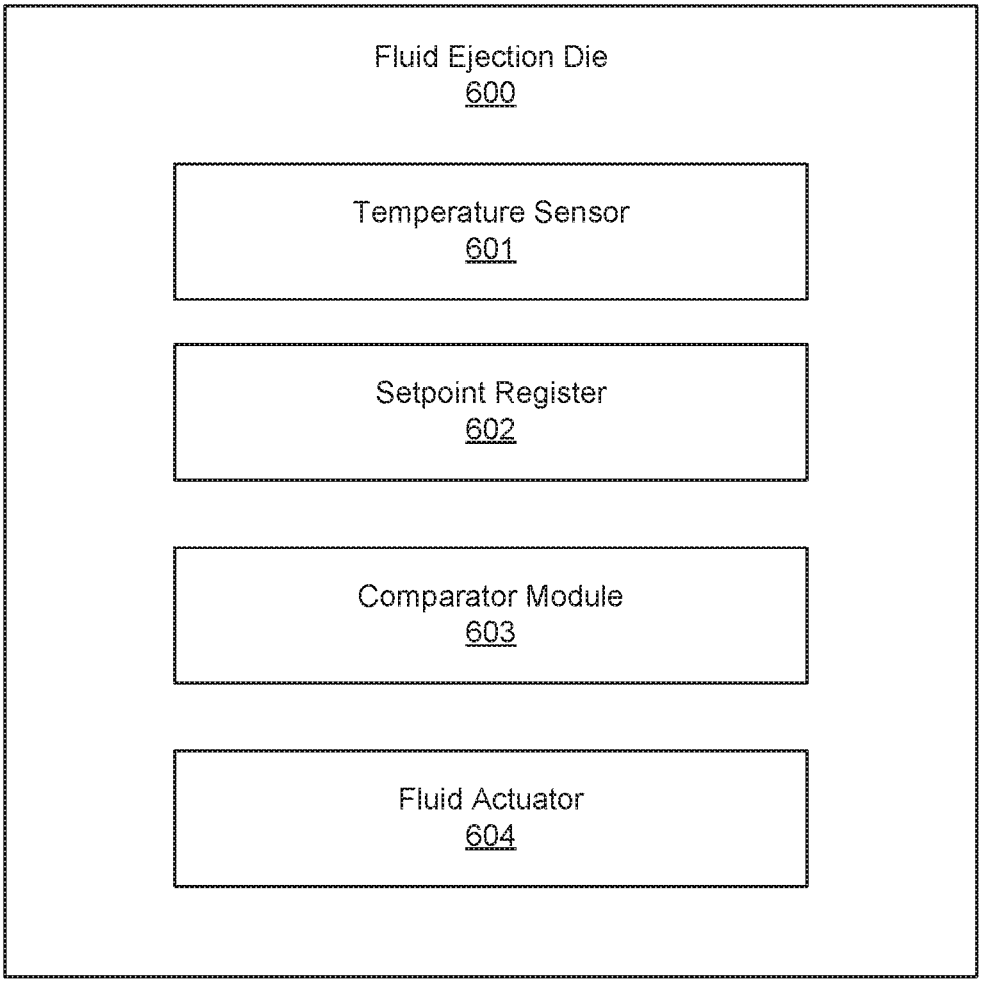
FIG. 6 is a block diagram of a fluid ejection die according to an example of the principles described herein.

FIG. 6 is a block diagram of a fluid ejection die (600) according to an example of the principles described herein. The fluid ejection die (600) may include at least one temperature sensor (601), at least one setpoint register (602), and a comparator module (603).

In an example, the fluid ejection die (600) may be partitioned into a number of zones as described herein. These zones may each include at least one temperature sensor (601), at least one comparator module (603), and at least one setpoint register (602). In an example, the temperature sensors (601), setpoint register (602), and/or comparator module (603) may be used across a plurality of the zones.

As described herein, the setpoint register (602) may be any digital storage element that maintains any digital count value equivalent to a target temperature setpoint. The setpoint register (602) may be used to hold a target temperature setpoint describing a temperature at the fluid ejection die (600) is to be held at. The comparator module (603) may then, during operation, compare the target temperature setpoint to a measured temperature by a temperature sensor (601) on at least one zone.

In the example shown in FIG. 6 may further include at least one fluid actuator (604) associated with at least one zone of the fluid ejection die (600). In an example, the fluid actuator (604) may be formed within a fluid channel formed into the fluid ejection die (600). In this example, the fluid actuator (604) may be a heating device used to heat the fluid in order to, at least, move fluid within the fluid ejection die (600). In an example, the fluid may be ejected from the fluid ejection die (600) using the fluid actuator (604). Examples of fluid actuators (604) may include a heating element such as a thermal resistive heating element, a piezoelectric membrane, or other types of devices that may move a fluid within the fluid ejection die (600).

Figure 7:
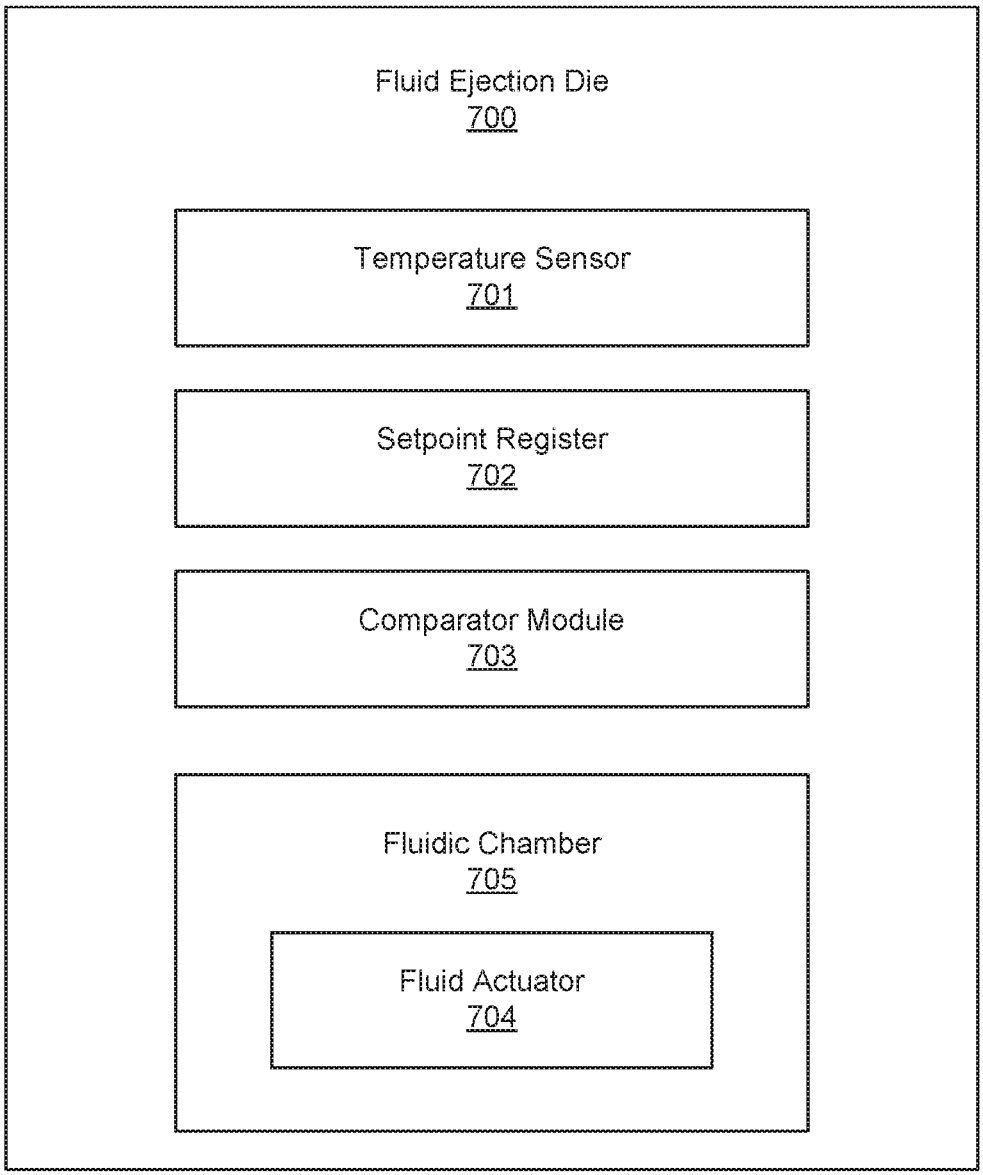
FIG. 7 is a block diagram of a fluid ejection die according to an example of the principles described herein.

In the example shown in FIG. 7, the fluid actuator (704) may be formed within a fluidic chamber (705). In this example, the fluidic chamber (705) may be fluidically coupled to a fluid source such as a fluid reservoir. A number of fluidic channels may be formed within the fluid ejection device (700) in order to fluidically couple the fluid reservoir to the fluidic chamber (705). During operation of the fluid ejection device (700), fluid may fill the fluidic chamber (705), the adjusted firing pulse may be received by the fluid actuator (704). In the example where the fluid actuator (704) is a heating element, the adjusted firing pulse is used to heat the heating element causing fluid to be ejected from the fluid ejection device (700). In this example, the degree to which the firing pulse has been adjusted causes the heating element to be heated relatively less or more based on the temperature of the fluid ejection device (700).

The specification and figures describe a setpoint register that helps to control the temperature of a die. Because the die may be separated into a number of zones, the circuit, system, and methods described herein provide for the maintaining of a consistent and appropriate drop qualities in spite of on-die temperature variations experienced by the die during operation. The circuit described herein may also provide for a die that ejects a relatively more consistent dropweight of fluid from the die. Also, in some examples, the analog-to-digital convertor and LUT described herein may be used across multiple zones of the die reducing the amount of space taken up by the circuit. Further, in some examples, the LUT may allow for flexibility and dialing in of adjustment values such that the die operates consistently over the lifetime of the die.

The preceding description has been presented to illustrate and describe examples of the principles described. This description is not intended to be exhaustive or to limit these principles to any precise form disclosed. Many modifications and variations are possible in light of the above teaching.

What is claimed is:

1. A fluidic die, comprising:

at least one temperature sensor coupled to at least one zone of the fluidic die;

a setpoint register to receive a target temperature setpoint for the fluidic die;

a comparator module to compare a detected temperature presented by the at least one temperature sensor to the target temperature setpoint to get a firing pulse adjustment value; and a pulse adjuster to adjust a firing pulse used to convey an amount of fluid within the die using the firing pulse adjustment value.

2. The fluidic die of claim 1, further comprising an analog-to-digital convertor to which each of an output terminal of the at least one temperature sensor is electrically coupled.

3. The fluidic die of claim 2, wherein the analog to digital converter converts an analog output of each of an output terminal of the at least one temperature sensor to a digital signal and provides the digital signal to the comparator module.

4. The fluidic die of claim 1, further comprising a look up table maintained on a storage device to determine how a firing pulse is to be adjusted using the firing pulse adjustment value.

5. The fluidic die of claim 4, wherein the target temperature setpoint is provided as a digital signal and the digital signal of each of an output terminal of the at least one temperature sensor are compared with the target temperature setpoint.

6. The fluidic die of claim 1, wherein adjusting the firing pulse comprises trimming a portion of the firing pulse by ignoring a number of clock counts when the temperature of the zone is hotter than the target temperature setpoint.

7. The fluidic die of claim 1, wherein adjusting the firing pulse comprises adding a number of clock counts to the firing pulse when the temperature of the zone is cooler than the target temperature setpoint.

8. A method for ejecting fluid, comprising:

loading a temperature setpoint value into a setpoint register on a fluidic die;

with a temperature sensor on the fluidic die, detecting a temperature value from at least one zone on the fluidic die;

comparing the temperature setpoint value with the temperature value to obtain a temperature difference value; and adjusting, with a pulse adjuster on the fluidic die, a firing pulse sent to fluid ejection devices on the fluidic die based on the temperature difference value.

9. The method of claim 8, wherein an analog-to-digital converter converts an analog signal from the temperature sensor into a digital signal to be compared with the temperature setpoint value.

10. The method of claim 8, wherein adjusting the firing pulse sent to the fluid ejection devices based on the difference value comprises implementing a look-up table to determine an amount the firing pulse is to be adjusted based on the temperature difference value.

11. The method of claim 8, wherein adjusting the firing pulse sent to the fluid ejection devices based on the difference value comprises trimming a portion of the firing pulse by ignoring a number of clock counts when the temperature value is hotter than the temperature setpoint value.

12. The method of claim 8, wherein adjusting the firing pulse sent to the fluid ejection devices based on the difference value comprises adding a number of clock counts to the firing pulse when the temperature value is cooler than the temperature setpoint value.

13. The method of claim 8, wherein:

the fluidic die comprises multiple zones of fluid actuators;

the firing pulse is adjusted per zone; and firing pulses for multiple zones are adjusted simultaneously.

14. The method of claim 8, further comprising determining the setpoint temperature value based on a type of fluid, materials of the die, and architecture of the die.

15. The method of claim 8, further comprising passing a zone select signal to a zone to trigger detection of the temperature value from the at least one zone.

16. A fluid ejection die, comprising:

multiple zones of fluid ejection devices, each zone comprising at least one fluid actuator formed within a fluidic chamber;

at least one temperature sensor per zone of the fluid ejection die;

a setpoint register to receive a target temperature setpoint for the zone die;

a comparator module to compare a detected temperature presented by the at least one temperature sensor to the target temperature setpoint to get a firing pulse adjustment value for the zone; and a pulse adjuster per zone to adjust a firing pulse used by the fluid actuator to convey an amount of fluid within the die using the firing pulse adjustment value.

17. The fluid ejection die of claim 16, wherein the fluid actuator is a heating element.

18. The fluid ejection die of claim 16, further comprising an analog-to-digital convertor to which each of an output terminal of the at least one temperature sensor is electrically coupled.

19. The fluidic die of claim 1, wherein:

the fluidic die comprises multiple zones of fluid actuators; and the firing pulse is adjusted per zone.

20. The fluidic ejection die of claim 16, further comprising:

a setpoint register per zone;

a comparator per zone; and an adjustment regulator per zone.

* * * * *